US007478643B2

(12) United States Patent
Hobson

(10) Patent No.: US 7,478,643 B2
(45) Date of Patent: Jan. 20, 2009

(54) UMBRELLA COVER

(76) Inventor: Donald A. Hobson, 4600 Don Quioxte Dr., Los Angeles, CA (US) 90008

( * ) Notice: Subject to any disclaimer, the term of this patent is extended or adjusted under 35 U.S.C. 154(b) by 166 days.

(21) Appl. No.: 11/436,954

(22) Filed: May 19, 2006

(65) Prior Publication Data

US 2007/0267052 A1 Nov. 22, 2007

(51) Int. Cl.
*A45B 25/24* (2006.01)

(52) U.S. Cl. ..... 135/34.2; 135/16

(58) Field of Classification Search ..... 135/16, 135/18, 48, 34.2, 25.41; 150/154, 159, 160, 150/161; 224/258, 186
See application file for complete search history.

(56) References Cited

U.S. PATENT DOCUMENTS

| | | | | | |
|---|---|---|---|---|---|
| 148,573 | A * | 3/1874 | Moschocowitz | ..... | 135/34.2 |
| 295,586 | A * | 3/1884 | Ross | ..... | 2/17 |
| 750,553 | A * | 1/1904 | Miller | ..... | 135/34.2 |
| 4,979,548 | A * | 12/1990 | Howard et al. | ..... | 150/159 |
| 5,383,505 | A * | 1/1995 | Cordasco, Jr. | ..... | 150/159 |
| 5,390,717 | A * | 2/1995 | Schenker et al. | ..... | 150/159 |
| 5,425,388 | A * | 6/1995 | Chen et al. | ..... | 135/34.2 |
| 5,620,034 | A * | 4/1997 | Flis | ..... | 150/159 |
| 5,718,333 | A * | 2/1998 | Armour | ..... | 206/315.4 |
| 6,805,144 | B2 * | 10/2004 | Usui et al. | ..... | 135/34.2 |
| 2001/0025647 | A1 * | 10/2001 | Chen et al. | ..... | 135/15.1 |
| 2001/0050097 | A1 * | 12/2001 | Fazel | ..... | 135/15.1 |

* cited by examiner

*Primary Examiner*—David Dunn
*Assistant Examiner*—James Alex

(57) ABSTRACT

There is provided a cover for umbrellas and the like.

The assembly includes a nearly cylindrical cover made of a material or materials that can have at least one waterproof layer. The cover is closed at one end to itself or to the article to which it is permanently attached. The opposite end of the cover is open and is bound to a rigid to semi-rigid often-deformable ring-like structure. When not in use or dormant, the cover is considered inside out which is the side that is often most waterproof and it will lay in approximation to the article to which it is attached. When the cover is employed, the ring is disposed over the article and the cover's closed end and urged along the article to the end of said cover. Thusly, the cover is inverted exposing its dry, clean exterior.

5 Claims, 11 Drawing Sheets

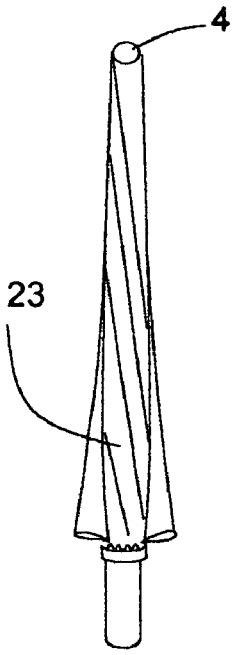
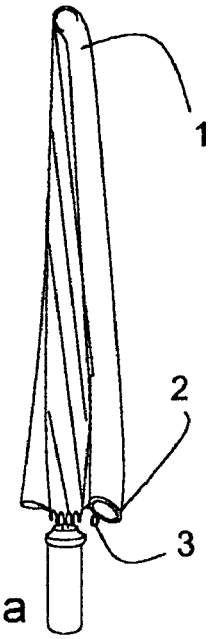
Fig.2a
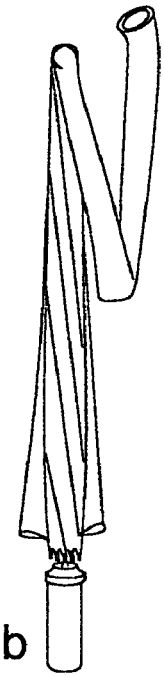
Fig.2b
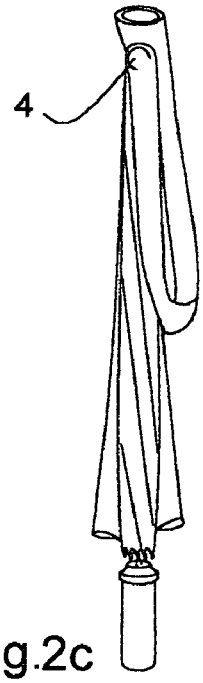
Fig.2c
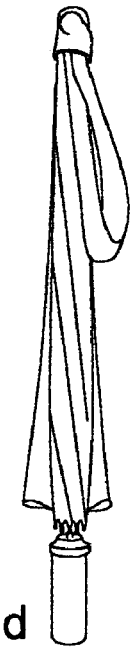
Fig.2d
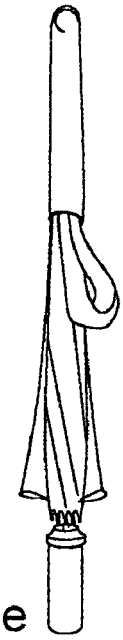
Fig.2e
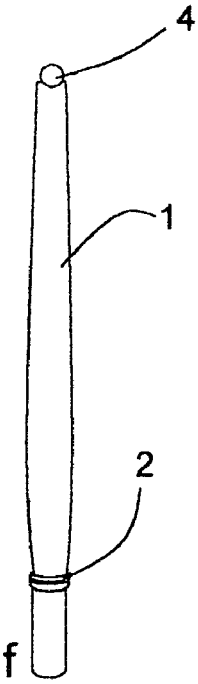
Fig.2f
Fig.2

UMBRELLA COVER

BACKGROUND OF INVENTION

1. Field of Invention

The present invention generally concerns covers for a conventional umbrella, which has a feature that secures the cover to an umbrella and is easy and convenient to manipulate as a person covers and uncovers an umbrella. In particular, the cover is permanently bound to a conventional umbrella thereby rendering a cover that cannot be lost or misplaced. When the umbrella is wet, the invertible water repellant cover will contain the moisture and present a dry outer surface.

2. Description of the Prior Art

For over a century patents designed to conveniently cover long and wet objects, in particular an umbrella, are on record. So far, no one has found an expeditious and moderately priced way to do so. Today, when a cover is included with an umbrella, or other sports equipment, it is the familiar additional sheath, which is an accessory most individuals seem not to be able to keep up with and/or consider too cumbersome to use.

U.S. Pat. No. 6,805,144 B2 (Usui et al) ('04) is a rigid folding cap style cover that collapses toward the umbrella handle. Unfortunately, the number and diameter of this mechanism necessary to extend the length of any umbrella would require the cover to be quite large therefore making it impractical and expensive to manufacture.

U.S. Pat. No. 6,334,454 B1 (Williams) has a separate rigid container that is bulky and can only be carried separately.

U.S. Pat. No. 5,135,017 (Fugiyama) ('92) is actually the reverse of U.S. Pat. No. 6,805,144 (Usai et al).

U.S. Pat. No. 5,111,835 (Lin) ('91) has a cover that attaches to the handle.

SUMMARY OF THE INVENTION

The present invention addresses the foregoing problems by providing:

A relatively cylindrical sheath or cover that either has a rigid to semi-rigid ring, a deformable ring or a ring-like member attached to one end of said cover. The opposite end of said cover can be attached either permanently or temporarily at or near one end of or desired area of the article that it will cover. When the cover is not in use, the cover is inverted exposing its underside, which in most applications is waterproof. When the cover is employed, for example over a collapsed umbrella, the ringed end of the cover is positioned over the top of the umbrella and the attached area of the cover and then urged along over the two. The once exposed side of the cover folds inward and approximates the often-wet outer side of the collapsed umbrella. Simultaneously, by folding out, the reverse unexposed side of the cover becomes exposed, which renders a clean and fashionable outer surface.

BRIEF DESCRIPTION OF THE DRAWINGS

FIG. 2 is a side view illustrating the detailed steps in covering a conventional collapsed umbrella according to a representative embodiment of the invention.

DRAWINGS

Reference Numerals

Figure 1:
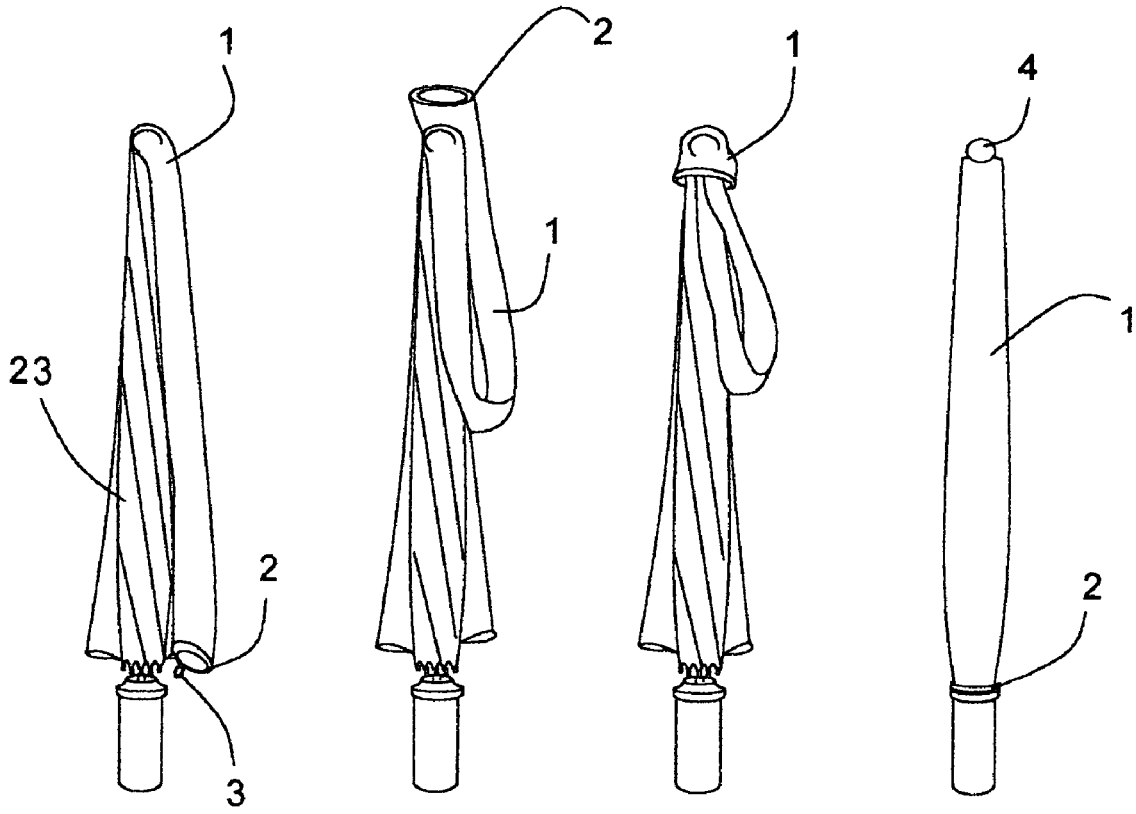
FIG. 1 is a side view illustrating the overall manipulation of the cover and ring assembly upon a collapsed umbrella according to a representative embodiment of the invention.

1 Cover
2 Ring
3 Fixating means; elastic band
4 Umbrella hub
5 Umbrella tip
6 Opened umbrella
7 Umbrella handle
8 Ring attachment (counterpart)
9 Retractable line mechanism
10 Retractable line
11 Cord
12 Expandable ring
13 Pressure releasing aperture
14 Temporary attachments means; a clip
15 Skis
16 Surfboard or ski board
17 Golf bag
18 Cover containment means
19 Extension for tying a cover
20 Modified umbrella hub
21 Additional cover
22 Adapter for additional cover
23 Collapsed umbrella
24 Umbrella extension or rib
25 Double or secondary end ring

DESCRIPTION OF THE PREFERRED EMBODIMENTS

In the drawings, closely related figures have the same number but different alphabetic suffixes.

FIG. 1 is a side view illustrating a collapsed umbrella 23 with cover 1 and end ring 2 attached and systematically illustrates how the cover is employed.

FIG. 2 is a side view illustrating more detailed steps in employment of the cover 1 and end ring 2 assembly upon a collapsed conventional uncovered umbrella 23. FIG. 2*a* is a side view illustrating a collapsed umbrella with the cover 1 and ring 2 assembly attached to said umbrella. FIGS. 2*b* and 2*c* are side views illustrating a collapsed umbrella with the cover ring in approximation to the hub of said umbrella. FIGS. 2*d* and 2*e* are side views illustrating a collapsed umbrella with the cover and ring being urged down the length of the umbrella and the remainder of the cover. FIG. 2*f* illustrates the resulting covered umbrella.

Figure 3:
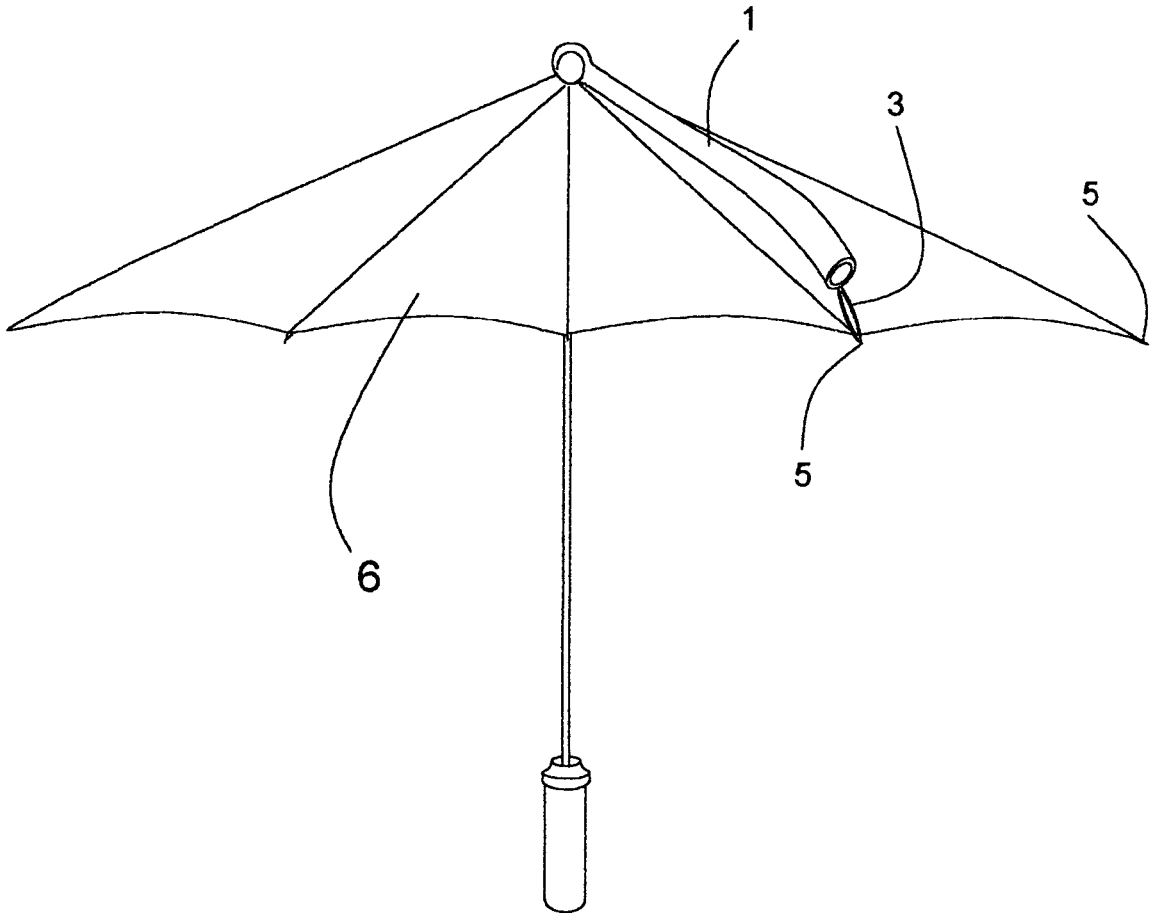
FIG. 3 is a side view illustrating an opened umbrella, cover and ring assembly according to a representative embodiment of the invention.

FIG. 3 is a side view illustrating how the attached inverted cover 1 and end ring 2 can lay on the top of a deployed or opened umbrella 6, and an elastic band 3 version of how the ring and cover can be temporarily affixed to the tip 5 of an umbrella rib 24.

Figure 4A:
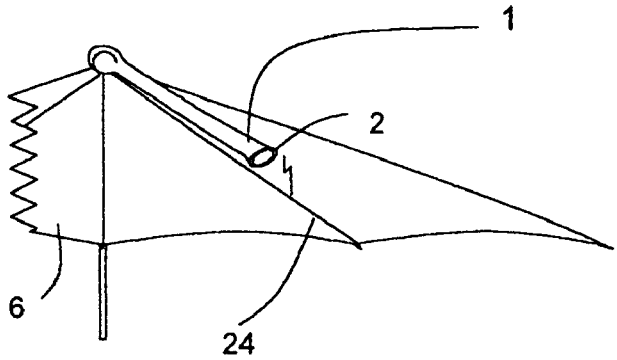
FIGS. 4*a*, 4*b*, 4*c*, and 4*d* are cutaway views illustrating how said cover and ring assembly may lay dormant or can be temporarily affixed to an opened umbrella according to a representative embodiment of the invention.
Figure 4B:
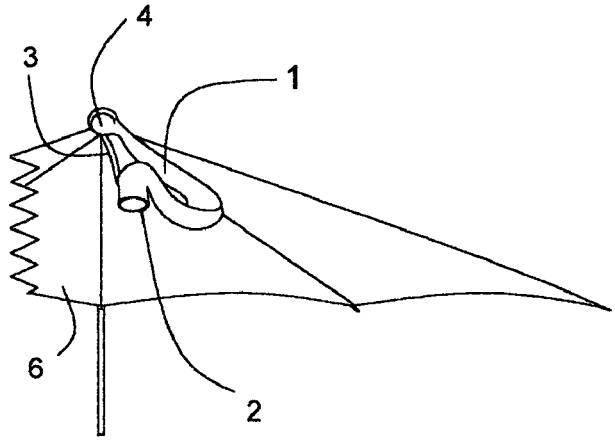
Figure 4C:
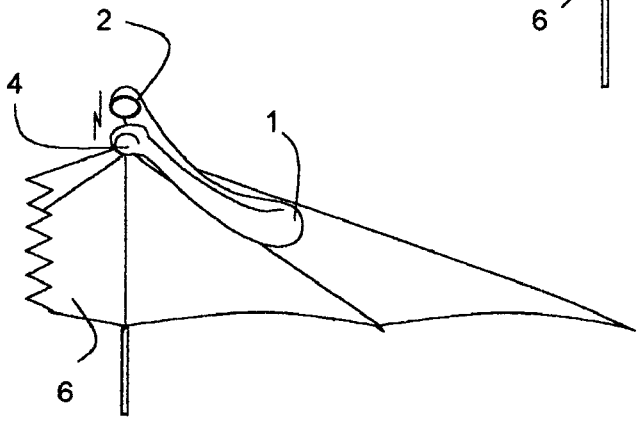
Figure 4D:
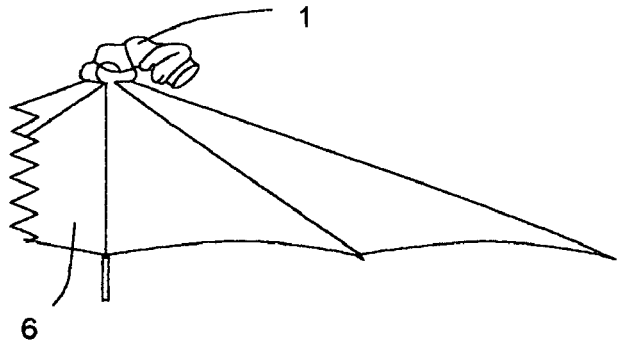

FIG. 4*a* is a cutaway view illustrating one particular embodiment of how the cover 1 and end ring 2 assembly may lay atop or upon a short multi-folded opened umbrella 6. The end ring 2 and/or part of the cover 1 is magnetized thereby affixing itself to one of the umbrella's rib or extensions 24. FIG. 4*b* illustrates an elastic band 3 that attaches at or near the end ring 2 and to the umbrella hub 4. FIG. 4*c* illustrates an end ring 2 that can adapt to the umbrella hub 4. FIG. 4*d* illustrates a cover 1 that gathers by means of inherent elastic memory and/or a retracting mechanism.

Figure 5:
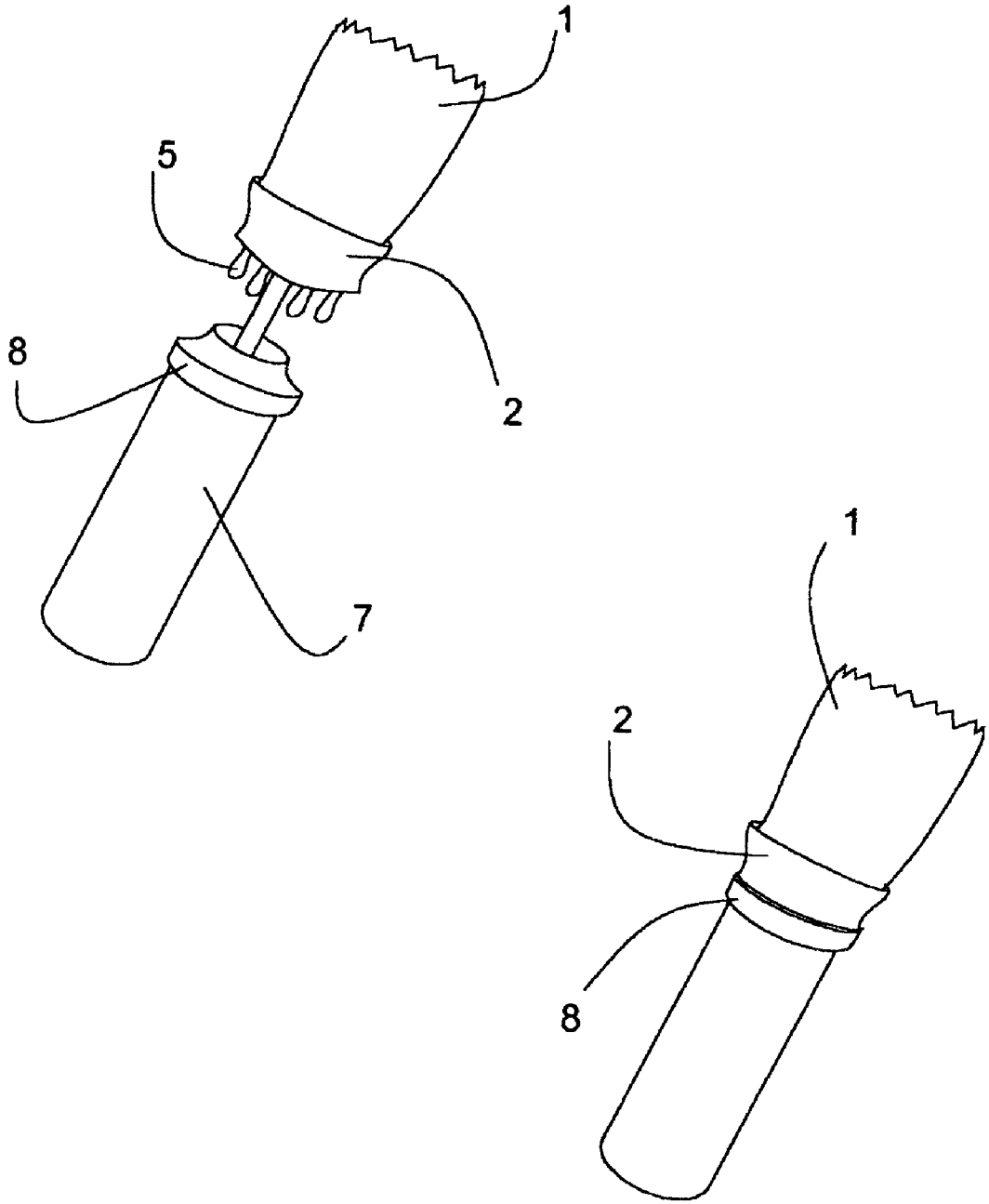
FIG. 5 is a magnified view illustrating a possible variation of the cover to handle connection according to a representative embodiment of the invention.

FIG. 5 illustrates one of the many shapes the cover ring 2 can have and one of the many ways it can fit the handle 7 and/or its hub 8, i.e., latches, magnetism, threaded fittings, rubber bushings, drawstrings, etc., which can completely close the umbrella.

Figure 6A:
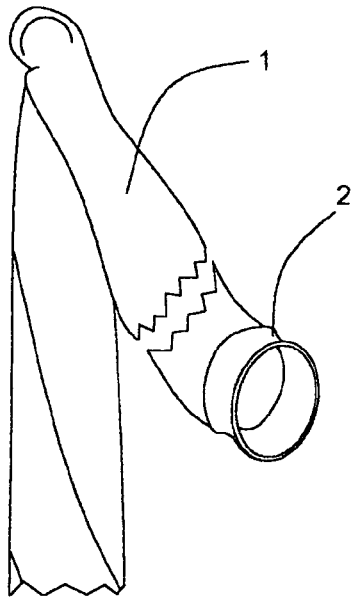
FIGS. 6*a* and 6*b* are side views illustrating two cover attachment possibilities and end ring shapes.
Figure 6B:
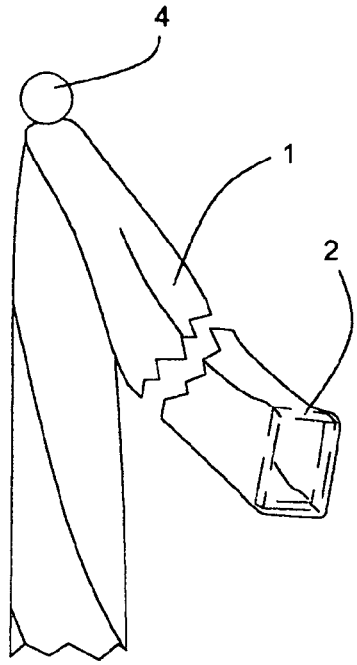
Figure 6C:
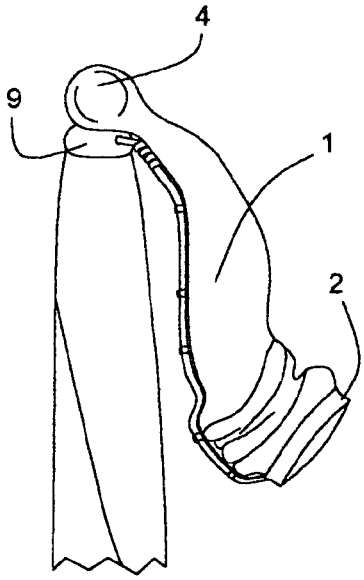
FIG. 6*c* illustrates a possible cover retraction mechanism; and 6*d* is a prospective view illustrating a double or secondary end ring 25 according to a representative embodiment of the invention.
Figure 6D:
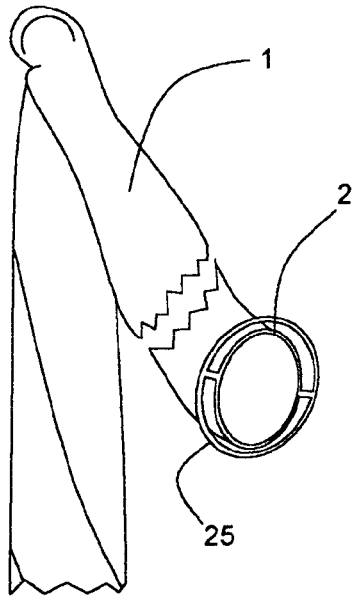
Figure 7A:
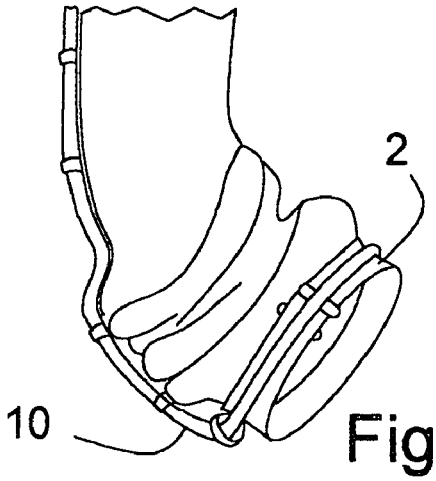
FIG. 7*a* is a magnified view illustrating an expandable ring influenced by the cord of a retraction mechanism.
Figure 7B:
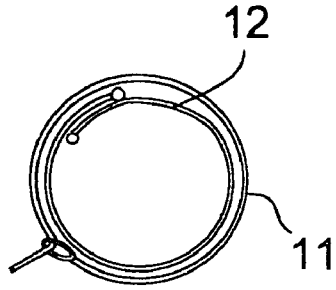
FIG. 7*b* is a magnified view illustrating an expanding ring influenced by an independent drawstring.
Figure 7C:
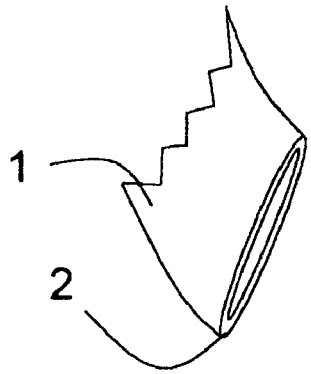
FIG. 7*c* is a magnified view illustrating a deformable or collapsible end ring.
Figure 7D:
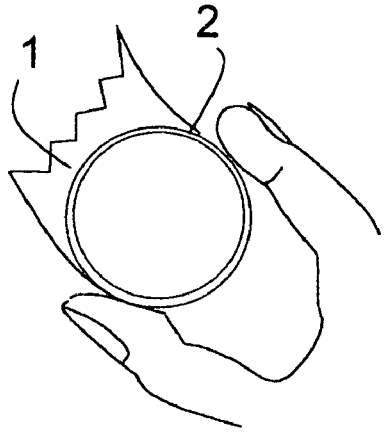
FIG. 7*d* is a magnified view illustrating a funnel shaped end ring according to a representative embodiment of the invention.
Figure 7D:
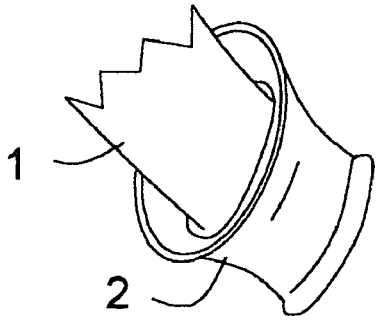

FIG. 6*a* is a magnified view illustrating one way the cover 1 can be attached to the main hub of an umbrella and one of the many possible shapes of the end ring 2. FIG. 6*b* illustrates another variation of the cover to hub attachment and possible shape of the end ring 2 sewn within a cuff of said cover. FIG. 6*c* illustrates a retracting mechanism 9 that can gather the cover 1. 6*d* illustrates a double or secondary end ring 25.

FIG. 7 is a magnified perspective view illustrating possible additional ring attributes. FIG. 7*a* illustrates a cord from the retracting mechanism that closes an expandable ring 2. FIG. 7*b* illustrates an expandable ring 2 influenced by an independent drawstring. FIG. 7*c* illustrates a collapsible ring 2 opened by finger pressure. FIG. 7*d* illustrates a funnel shaped end ring 2.

Figure 8A:
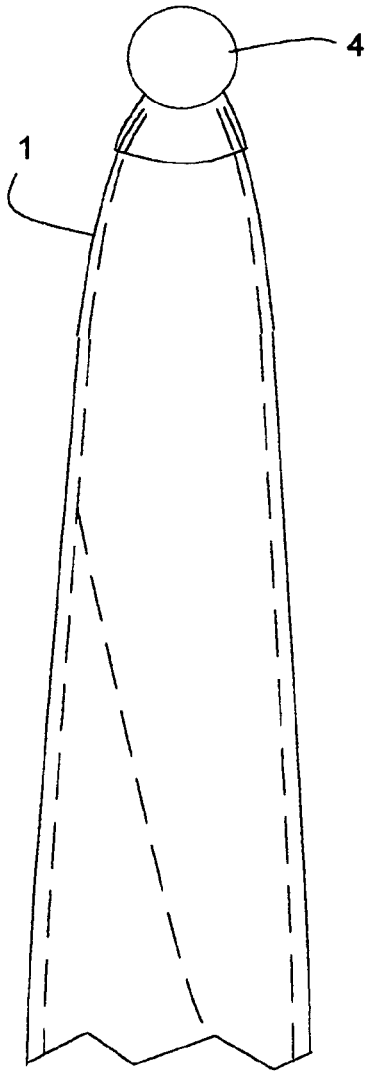
FIG. 8*a* is a magnified view illustrating a permanent cover attachment to an umbrella hub and FIG. 8*b* is a magnified view illustrating a temporary cover attachment according to a representative embodiment of the invention.
Figure 8B:
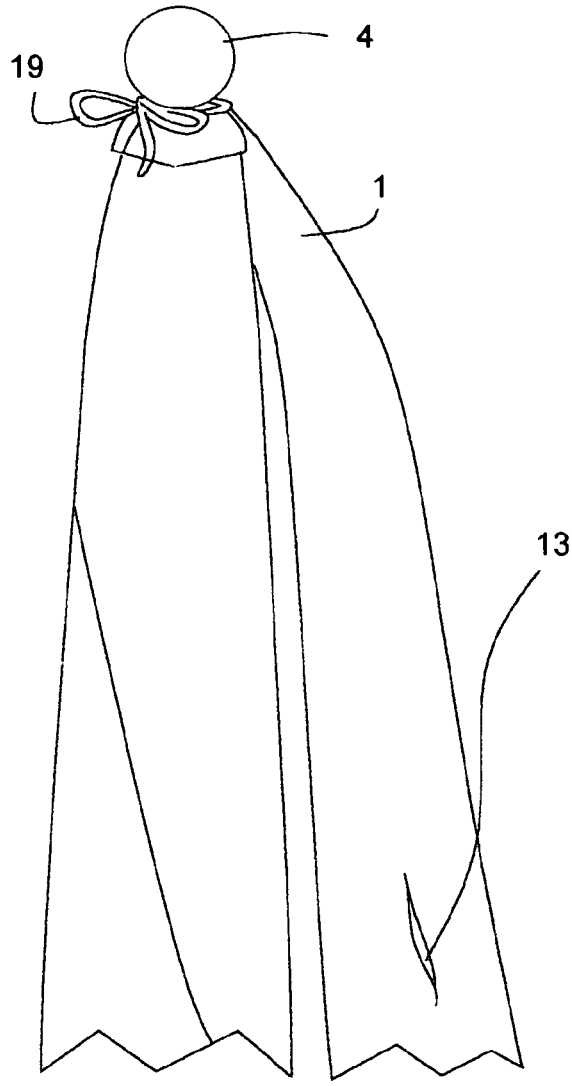

FIG. 8*a* is a side view illustrating the cover 1 permanently bound to an umbrella hub 4. FIG. 8*b* is a side view illustrating a closed cover with extensions 19 for tying a cover to an article and illustrating an auxiliary pressure-releasing aperture 13.

Figure 9A:
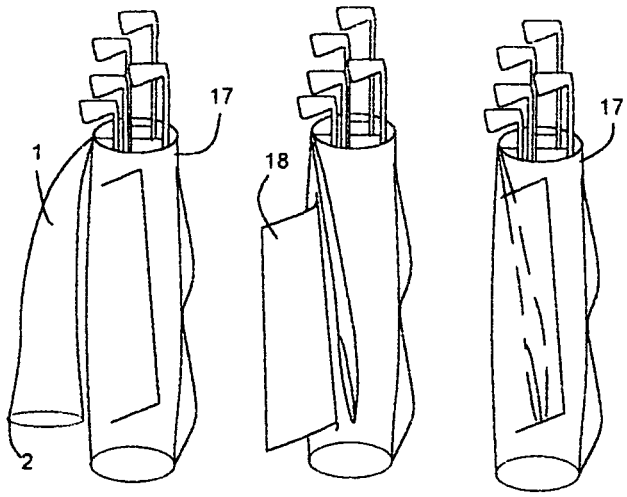
FIGS. 9*a*, 9*b*, 9*c*, and 9*d* are side views illustrating a cover assembly utility for sports equipment according to a representative embodiment of the invention.
Figure 9B:
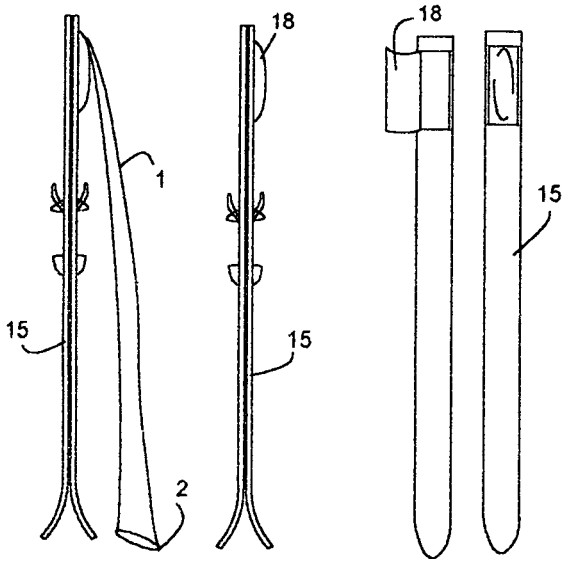
Figure 9C:
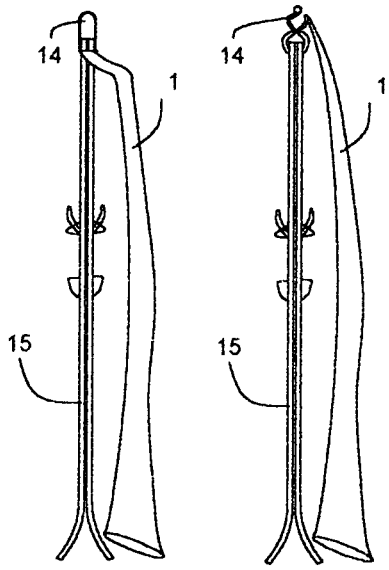
Figure 9D:
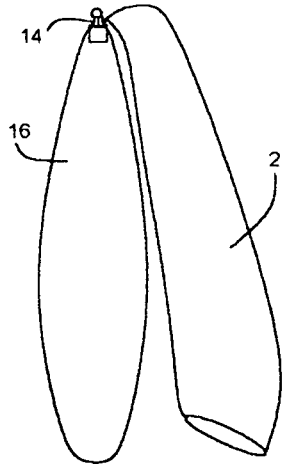

FIG. 9*a* illustrates a cover 1 and end ring 2 assembly attachment to a golf bag 17 wherein said cover can be stowed and/or fixated by a cover flap or pocket means 18. FIG. 9*b* illustrates a cover 1 and end ring 2 assembly attachment to skis 15 with a cover flap or pocket 18. FIG. 9*c* illustrates a cover 1 and end ring 2 assembly that is temporarily attached to skis by a clamping means or the like 14. 9*d* illustrates a cover 1 and end ring 2 assembly attachment wherein the cover is temporarily attached to a surf or ski board 16 by a clamp 14.

Figure 10:
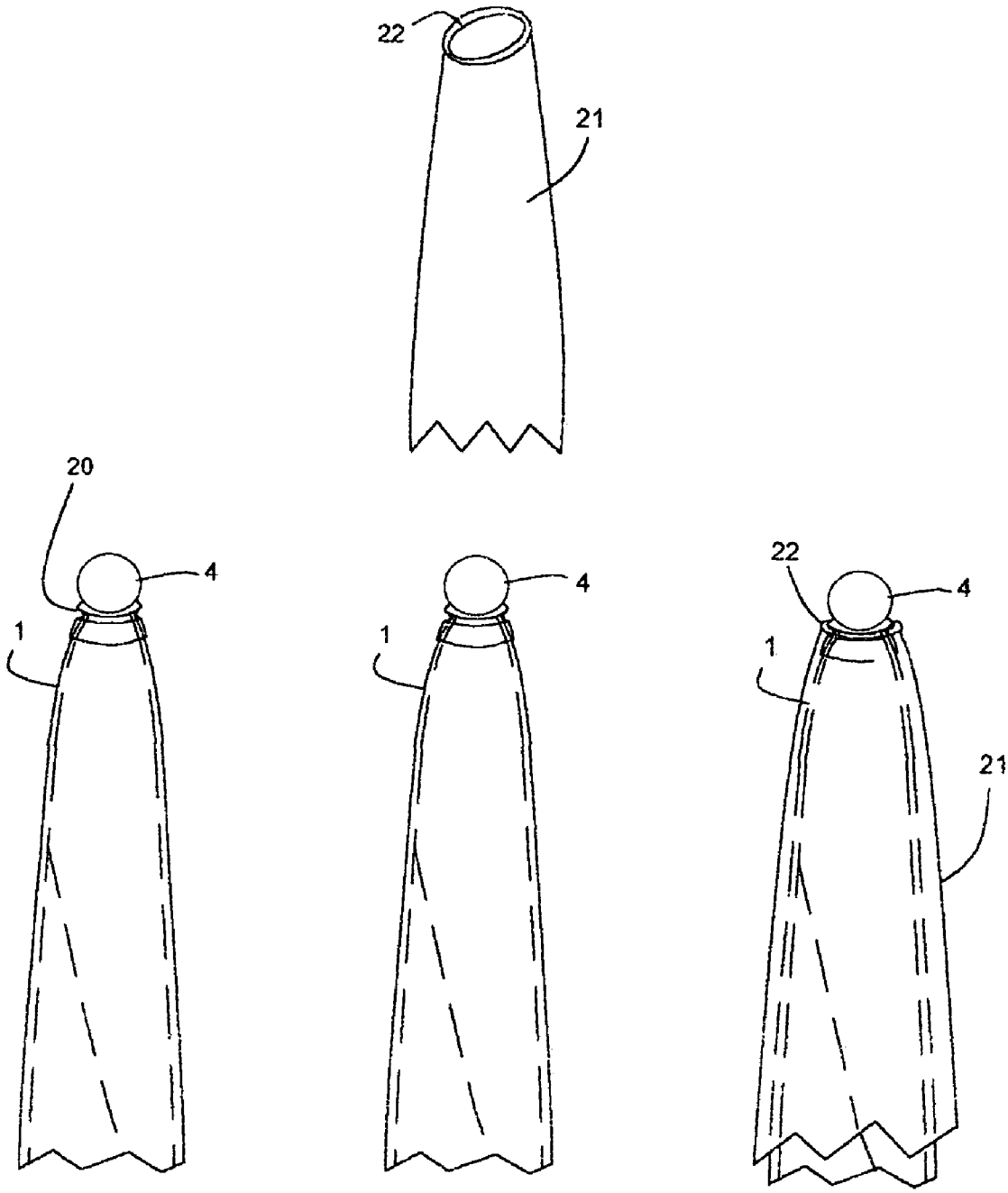
FIG. 10 is a side view illustrating one possible variation of an additional or secondary cover or covers according to a representative embodiment of the invention.

FIG. 10 is a side view illustrating one possible method of attaching an additional cover 21 by modifying the hub 4 to accept an adapter or a fixating means 22. A similar method would attach the additional cover to the end ring.

Figure 11:
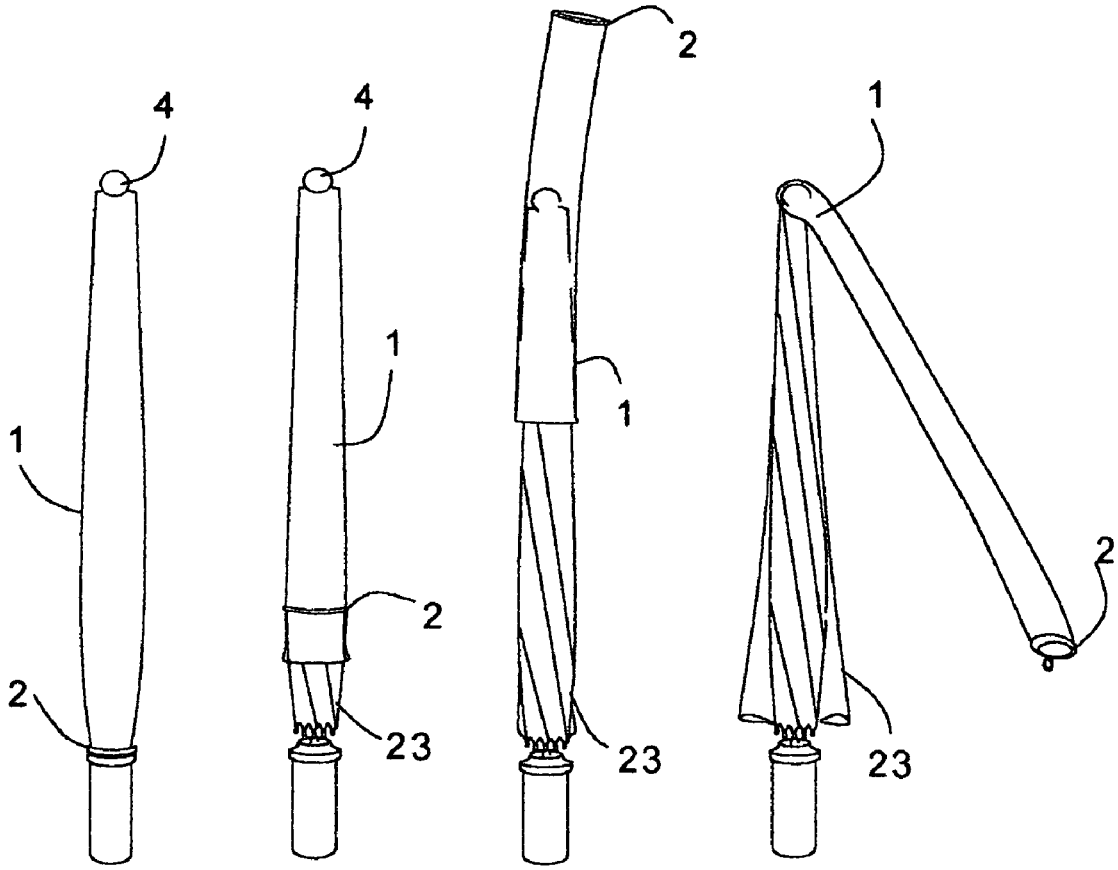
FIG. 11 is a side view illustrating the overall manipulation of removing the cover from a conventional umbrella.

FIG. 11 is a side view illustrating the manipulation of the end ring 2 to remove the cover 1 from a collapsed umbrella 23. As the ring 2 is urged toward the hub 4, the outer surface of said cover folds onto itself exposing its inside surface. Once said cover has cleared the umbrella, the umbrella can then be deployed.

Although the present invention has been described in detail with regard to the exemplary embodiments and drawings thereof, it should be apparent to those skilled in the art that various adaptations and modifications of the present invention may be accomplished without departing from the spirit and scope of the invention. Accordingly, the invention is not limited to the precise embodiment shown in the drawings and described in detail hereinabove. Rather, it is intended that all such variations not departing from the spirit of the invention be considered as within the scope thereof as limited solely by the claims appended hereto.

In addition, several different embodiments of the present invention are described above, with each such embodiment described as including certain features. However, it is intended that the features described in connection with the discussion of a single embodiment are not limited to that embodiment but may be included and/or arranged in various combinations in any of the other embodiments as well, as will be understood to those skilled in the art.

In the following claims, those elements which do not include the words "means for" are intended not to be interpreted under 35 U.S.C. §112¶6.

Patents Cited:

| | | |
|---|---|---|
| 6,805,144 | Usai et al | (2004) |
| 5,443,086 | Maller | (1994) |
| 6,334,454 B1 | Williams | |
| 5,135,017 | Fugiyama | (1992) |
| 4,375,222 | Dubinsky | (1983) |
| 4,062,370 | Brickner, et al. | (1977) |
| 141,151 | Lusby | (1873) |
| 337,146 | Ghezzi | (1886) |
| 785,938 | Epstein | (1905) |
| 3,948,302 | Kohls | (1976) |
| 6,763,941 | Laffy | (2004) |
| 6,367,625 | Zobel | (2002) |

What is claimed is:

1. An umbrella comprising a hub or ferrule, a canopy, a rib, and a cover which prevents the umbrella from wetting its surroundings said cover comprising:

(a) a single elongated, flexible and invertible tubular sleeve formed of a pliable waterproof material having two ends;

(b) one end of said sleeve having an orifice that is closed and is permanently attached at the hub or ferule of said umbrella;

(c) the opposite end of said sleeve having an orifice that is circumambiently bound to a sturdy ring that maintains the patency of said sleeve's orifice and is used to manipulate and guide said sleeve's orifice, wherein said sleeve is led, up, down, on and off the circumference of a collapsed umbrella thereby directing the inversion process of said umbrella cover;

(d) said sleeve is sized to house the entire canopy of said collapsed umbrella and said ring is sized to fit circumambiently to the orifice of said sleeve;

(e) wherein said cover lays inside out atop said canopy when dormant; and (f) wherein said cover has a looped material band attached as a tangent at said ring-bound end of said cover; in said cover's dormant state, said cover is immobilized when said loop is placed around the tip of said rib.

2. The cover of claim 1 wherein said sleeve is typically made of, but not limited to, the same material and typically possesses the same aesthetic patterns and colors as the canopy of said umbrella to which said sleeve is attached.

3. The cover of claim 1 wherein said cover inverts the wet or environmentally exposed dormant side inward as said cover is deployed over said collapsed canopy.

4. The cover of claim 1 wherein said ring of said cover is collapsible upon itself thereby temporarily closing said ring-bound orifice of said cover.

5. The cover of claim 1 wherein said ring of said cover is constrictive thereby temporarily closing the said ring-bound orifice of said cover.

* * * * *